US011292254B2

(12) United States Patent
Miwa et al.

(10) Patent No.: US 11,292,254 B2
(45) Date of Patent: Apr. 5, 2022

(54) LIQUID DISCHARGE HEAD, DISCHARGE DEVICE, LIQUID DISCHARGE APPARATUS, AND BONDED SUBSTRATE

(71) Applicant: Ricoh Company, Ltd., Tokyo (JP)

(72) Inventors: Keishi Miwa, Kanagawa (JP); Takahiko Kuroda, Kanagawa (JP); Toshiaki Masuda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 20 days.

(21) Appl. No.: 17/097,629

(22) Filed: Nov. 13, 2020

(65) Prior Publication Data

US 2021/0162759 A1 Jun. 3, 2021

(30) Foreign Application Priority Data

Nov. 29, 2019 (JP) ..... JP2019-216047

(51) Int. Cl.
*B41J 2/14* (2006.01)

(52) U.S. Cl.
CPC ..... *B41J 2/14201* (2013.01)

(58) Field of Classification Search
CPC ..... B41J 2/14201; B41J 2002/14362; B41J 2/14233; B41J 2202/12
See application file for complete search history.

(56) References Cited

U.S. PATENT DOCUMENTS

2015/0171307 A1 6/2015 Masuda et al.
2016/0001556 A1* 1/2016 Masuda ..... H01L 41/047 347/71
2017/0100934 A1 4/2017 Masuda et al.
2019/0275796 A1 9/2019 Miwa

FOREIGN PATENT DOCUMENTS

JP 2016/0001556 A1 8/2013

OTHER PUBLICATIONS ip.com search (Year: 2022).*

* cited by examiner

*Primary Examiner* — Lisa Solomon
(74) *Attorney, Agent, or Firm* — Xsensus LLP

(57) ABSTRACT

A liquid discharge head includes a nozzle configured to discharge a liquid, a pressure chamber communicating with the nozzle, a pressure generator configured to apply pressure on the pressure chamber, a first substrate including a terminal electrode connected to the pressure generator, and a second substrate including a bonding surface bonded to the first substrate, the second substrate including a terminal opening exposing the terminal electrode of the first substrate. The first substrate includes a through hole penetrating through the first substrate, and the second substrate includes a communication hole communicating with the through hole of the first substrate and an air communication channel on a surface opposite to the bonding surface, the air communication channel communicating with the terminal opening and the communicating hole.

10 Claims, 9 Drawing Sheets

FIG. 5

| | CHANNEL WIDTH W1 (μm) | INTERVAL D1 (μm) | DEFORMATION OF PROTECTION TAPE | INVASION OF FILM-FORMING GAS |
|---|---|---|---|---|
| EXAMPLE 1 | 5 | 20 | NOT OCCURED | NOT OCCURED |
| EXAMPLE 2 | 5 | 30 | NOT OCCURED | NOT OCCURED |
| EXAMPLE 3 | 5 | 40 | NOT OCCURED | NOT OCCURED |
| EXAMPLE 4 | 10 | 40 | NOT OCCURED | NOT OCCURED |
| EXAMPLE 5 | 15 | 40 | NOT OCCURED | NOT OCCURED |
| EXAMPLE 6 | 50 | 40 | NOT OCCURED | NOT OCCURED |
| EXAMPLE 7 | 75 | 40 | NOT OCCURED | NOT OCCURED |
| EXAMPLE 8 | 100 | 40 | NOT OCCURED | NOT OCCURED |
| COMPARATIVE EXAMPLE 1 | NO AIR COMMUNICATION CHANNEL | | OCCURED | OCCURED |

LIQUID DISCHARGE HEAD, DISCHARGE DEVICE, LIQUID DISCHARGE APPARATUS, AND BONDED SUBSTRATE

CROSS-REFERENCE TO RELATED APPLICATION

This patent application is based on and claims priority pursuant to 35 U.S.C. § 119(a) to Japanese Patent Application No. 2019-216047, filed on Nov. 29, 2019, in the Japan Patent Office, the entire disclosures of which is hereby incorporated by reference herein.

BACKGROUND

Technical Field

Aspects of the present disclosure relate to a liquid discharge head, a discharge device, a liquid discharge apparatus, and a bonded substrate.

Related Art

For example, a liquid discharge head includes a bonded substrate in which a first substrate and a second substrate are bonded. The first substrate includes a pressure chamber communicating with a nozzle to discharge a liquid, a pressure generating element, and a terminal electrode connected to the pressure generating element. The second substrate includes a channel to supply a liquid to the pressure chamber of the first substrate, and the like.

The liquid discharge bead includes a nozzle plate, a channel substrate, a driver, a diaphragm, and a holding substrate. The holding substrate is bonded to the channel plate on a side opposite to a nozzle plate. The holding substrate includes a space surrounded by the holding substrate and the channel substrate at a position facing the driver on the channel substrate. The space communicates with atmosphere through a groove in the holding substrate.

SUMMARY

In an aspect of this disclosure, a liquid discharge head includes a nozzle configured to discharge a liquid, a pressure chamber communicating with the nozzle, a pressure generator configured to apply pressure on the pressure chamber, a first substrate including a terminal electrode connected to the pressure generator, and a second substrate including a bonding surface bonded to the first substrate, the second substrate including a terminal opening exposing the terminal electrode of the first substrate. The first substrate includes a through hole penetrating through the first substrate, and the second substrate includes a communication hole communicating with the through hole of the first substrate and an air communication channel on a surface opposite to the bonding surface, the air communication channel communicating with the terminal opening and the communication hole.

In another aspect of this disclosure, a bonded substrate includes a first substrate including a terminal electrode, and a second substrate including a bonding surface bonded to the first substrate, the second substrate including a terminal opening exposing the terminal electrode of the first substrate. The first substrate includes a through hole penetrating through the first substrate, and the second substrate includes a communication hole communicating with the through hole of the first substrate and an air communication channel on a surface opposite to the bonding surface, the air communication channel communicating with the terminal opening and the communicating hole.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein:

FIG. 5 is a table illustrating the specific example of the invasion of the film-forming gas in the bonded substrate;

Figure 1:
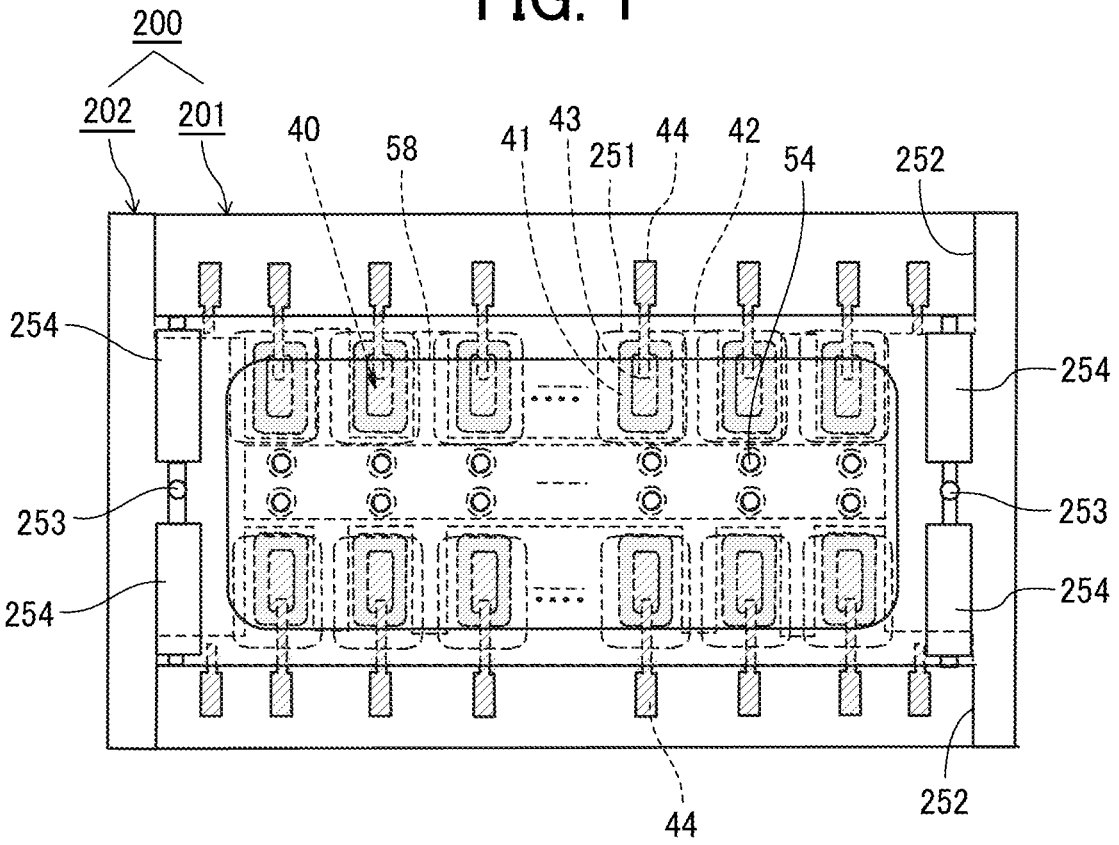
FIG. 1 is a schematic plan view of a bonded substrate of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms “a,” “an,” and "the" are intended to include the plural forms as well, unless the context clearly indicates otherwise.

Embodiments of the present disclosure are described below with reference to the attached drawings. A bonded substrate 200 of a liquid discharge head 1 according to a first embodiment of the present disclosure is described with reference to FIGS. 1 to 3. The bonded substrate 200 forms a part of a liquid discharge head 1 (see FIG. 6). Hereinafter, the "liquid discharge head" is simply referred to as a "head."

FIG. 1 is a schematic plan view of a bonded substrate 200 of the head 1 according to the first embodiment of the present disclosure.

Figure 2A:
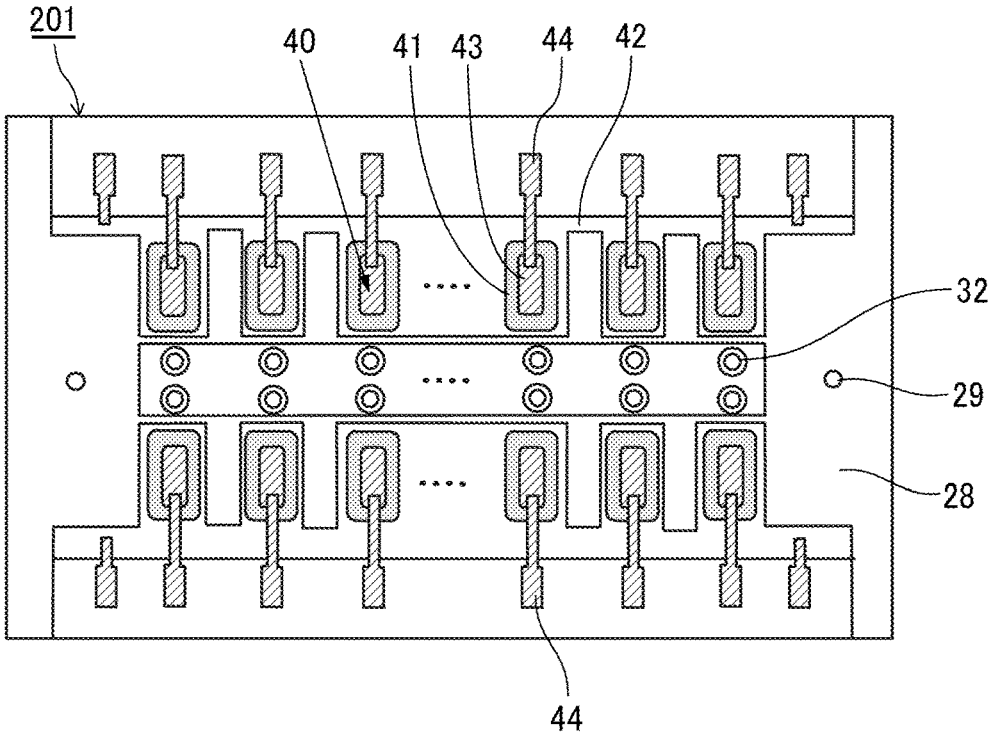
FIGS. 2A and 2B are schematic plan views of a first substrate and a second substrate of the bonded substrate.
Figure 2B:
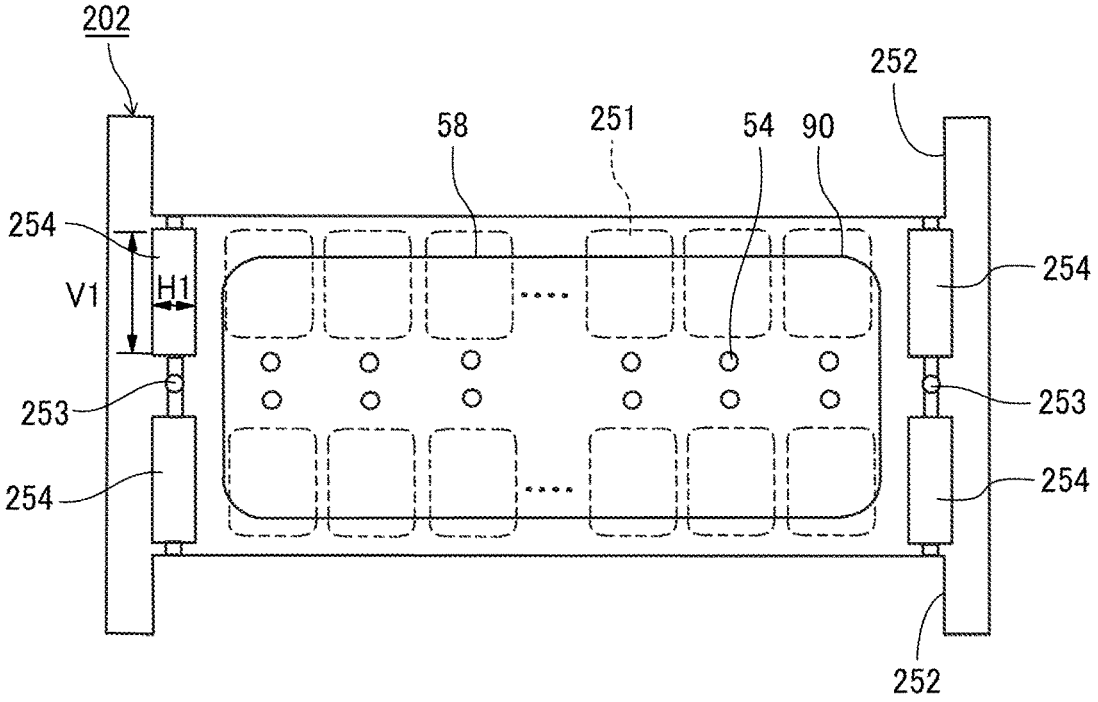

FIGS. 2A and 2B are schematic plan views of a first substrate 201 and a second substrate 202 of the bonded substrate 200.

Figure 3:
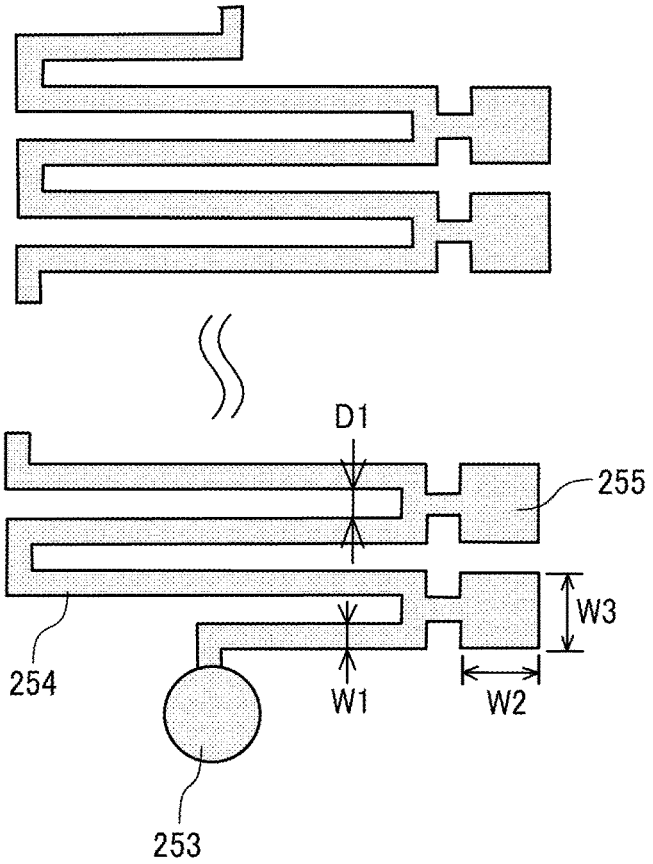
FIG. 3 is a schematic plan view of a specific configuration of an air communication channel of the second substrate.

FIG. 3 is a schematic plan view of an air communication channel of the second substrate 202.

The first substrate 201 is bonded to the second substrate 202 with an adhesive and the like to form a substrate as the bonded substrate 200. The bonded substrate 200 forms a part of the head 1 (see FIG. 6) to discharge a liquid.

The first substrate 201 includes two rows of a plurality of rows of piezoelectric elements 40. The piezoelectric elements 40 are pressure generators to generate a pressure to apply a pressure on a pressure chamber communicating with a nozzle from which a liquid is discharged. The piezoelectric element 40 includes a piezoelectric body 41, a lower electrode 42, and upper electrodes 43. The lower electrode 42 serves as a common electrode. The tipper electrodes 43 serve as individual electrodes. The lower electrode 42 and the upper electrode 43 sandwich the piezoelectric body 41. The first substrate 201 includes a terminal electrode 44 connected to the upper electrode 43.

The first substrate 201 includes supply openings 32 that serve as a plurality of supply ports to supply liquids to a plurality of pressure chambers.

The first substrate 201 includes a base 28 to be bonded to the second substrate 202. The base 28 includes through holes 29 that penetrate the first substrate 201.

The second substrate 202 includes a common supply channel 58 and a supply port 54. The supply port 54 communicates the common supply channel 58 and the supply openings 32 of the fast substrate 201.

The second substrate 202 includes an accommodating portion 251 and a terminal opening 252. The accommodating portion 251 accommodates the piezoelectric element 40 of the first substrate 201. The terminal opening 252 exposes the terminal electrode 44 of the first substrate 201.

The second substrate 202 includes a communication hole 253 that communicates with the through hole 29 of the first substrate 201. The second substrate 202 includes an air communication channel 254 on a surface opposite to a bonded surface to be bonded to the first substrate 201. The air communication channel 254 communicates the terminal opening 252 and the communication hole 253.

The air communication channel 254 and the communication hole 253 are formed on each ends of the second substrate 202 in a longitudinal direction (lateral direction in FIG. 2B) of the second substrate 202.

Here, as illustrated in FIG. 3, the air communication channel 254 has a pattern formed in a square waved shape meandering between the communication hole 253 and the terminal opening 252. A plurality of gas detection chambers 255 communicates with the air communication channel 254 at predetermined intervals.

Figure 4:
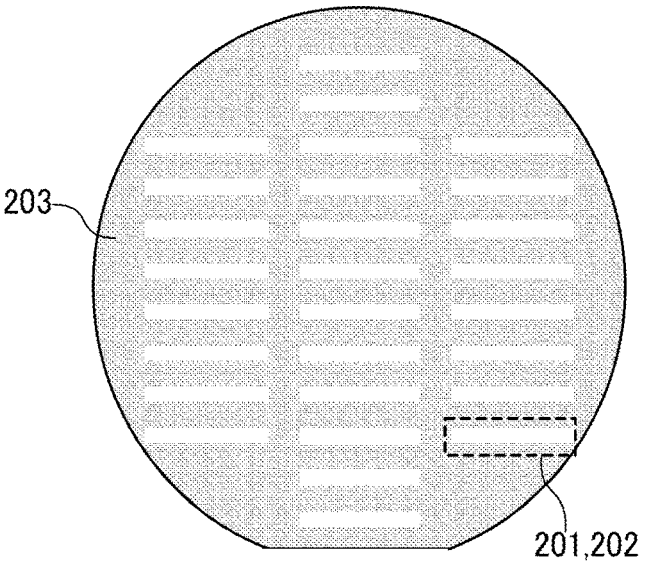
FIG. 4 is a plan view of a wafer from which multiple of the first substrates and the second substrates are taken.

Next, a function of the present embodiment is described with reference also to FIG. 4. FIG. 4 is a plan view of a wafer from which multiple of the first substrates 201 and the second substrates 202 are taken.

To form the first substrate 201, a 6-inch silicon substrate 203 is used to form a required thin-film by a chemical vapor deposition (CVD) method, a sputtering method, a spin coating method, or the like to form the first substrate 201, for example. The, the thin-film is processed by a photolithography method to manufacture a large number of the first substrates 201 in the silicon substrate 203. The large number of the first substrates 201 in the silicon substrate 203 are then divided into individual first substrates 201. Similarly, a large number of second substrates 202 are firmed on the silicon substrate 203 and divided into individual second substrates 202 to form the second substrate 202.

Then, the first substrate 201 bonded to the second substrate 202 forms a liquid-resistant protection film 90 that protects the wall surface of the channel. Hereinafter, the "liquid-resistant protection film 90" is simply referred to as a "protection film 90." A plurality of bonded substrates 200 are arranged in a chamber of a protection-film forming apparatus and are batch-processed to form the protection film 90 to improve productivity. The protection film 90 is formed in an area of the common supply channel 58 except an area of the supply port 54 through which the liquid passes. The protection film 90 is formed around a side surface of the supply port 54.

In the batch process, the protection film 90 is adhered to an entire surface of the first substrate 201 and the second substrate 202. However, the protection film 90 is an insulation film. Therefore, if the protection film 90 is adhered onto the terminal electrode 44, an external electrical connection between the terminal electrode 44 and the upper electrode 43 may be insulated. Therefore, a protection tape cut out in a shape of the substrate is attached to a surface of the second substrate 202 opposite to a surface of the second substrate 202 to be bonded to the first substrate 201. Then, the protection film 90 is formed on the bonded substrate 200.

Thus, the protective film is not formed on the terminal electrode 44, and the protective film can be formed on the common supply channel 58, the supply port 54, the supply opening 32, and the pressure chamber collectively serving as a channel (channels).

Thus, the bonded substrate 200 includes a channel configured to supply the liquid to the pressure chamber 21, and the through hole 29 of the first substrate 201 is separated from the channel. Further, the communication hole 253 of the second substrate 202 is separated from the channel.

However, it is preferable to attach the protection tape to the second substrate 202 in a vacuum state to reduce generation of voids between the protection tape and the second substrate 202. When the bonded substrate 200 is returned to a state from a vacuumed state to an atmospheric pressure after attaching the protection tape, a part (space) that is surrounded by the protection tape, the first substrate 201, and the second substrate 202 becomes a vacuumed state. The part (space) does not penetrate the first substrate 201 and the second substrate 202.

In the bonded substrate 200 according to the first embodiment, the terminal opening 252 is opened to the atmosphere in a vacuum state. Then, the protective tape of the terminal electrode 44 in a vacuum state is pushed toward the first substrate 201 side and is greatly deformed under atmospheric pressure.

A deformation of the protection tape may cause peeling off of the protection tape from the common supply channel 58 and the terminal opening 252, for example. Then, the film-forming gas invades from the supply port 54 when the protection film 90 is formed, and the protection film 90 is formed on the terminal electrode 44.

Even if the protection film 90 can be film-formed without causing the peeling off of the protection tape from the bonded substrate 200 while the protection tape is deformed under the atmospheric pressure, a formation process of the protection film 90 has to be performed under a higher vacuum state than a vacuum state in which an attaching process of the protection tape is performed. Then, the terminal opening 252 may expand that causes the peeling off of the protection tape from the bonded substrate 200.

To solve a problem of peeling off of the protection tape, a protection tape having high adhesion may be used to reduce deformation of the protection tape due to a pressure difference between an interior and an exterior of the protection tape. However, a protective tape having high adhesion may generate a large amount of outgassing under the vacuumed state. The outgassing may cause deterioration of film quality of the protection film 90. Further, component of the outgassing attached to the bonded substrate 200 may reduce an adhesion strength of the protection film 90.

On the other hand, if a protection tape having high rigidity is used to reduce deformation of the protection tape, there are few such tapes that can reduce the deformation of the protection tapes and also having high heat resistance. Further, if a thickness of the protection tape is increased to increase the rigidity of the protection tape, the protection tape itself becomes difficult to be processed that causes problems such as air bubbles caught between the protection tape and the bunded substrate 200 when the protection tape is attached to the bonded substrate 200.

Thus, the bonded substrate 200 according to the first embodiment includes the air communication channel 254 and the communication hole 253 in the second substrate 202. Further, the air communication channel 254 and the communication hole 253 of the second substrate 202 communicate with the terminal opening 252 and the through hole 29 of the first substrate 201 that becomes the vacuumed state after the attachment process of the protection tape on the bonded substrate 200.

Thus, a pressure in the terminal opening 252 becomes the atmospheric pressure through the through hole 29, the communication hole 253, and the air communication channel 254 when the bonded substrate 200 is returned to a state under the atmospheric pressure. Thus, the bonded substrate 200 according to the first embodiment can reduce deformation of the protection tape. When the terminal opening 252 expands in a high vacuum chamber when the protection film 90 is formed, a pressure in the terminal opening 252 also becomes a high vacuum through the through hole 29, the communication hole 253, and the air communication channel 254. Thus, the bonded substrate 200 according to the first embodiment can reduce deformation of the protection tape.

Therefore, the bonded substrate 200 according to the first embodiment can prevent film-formation of the protection film 90 on the terminal electrode 44, and reliability of an electrical connection between the terminal electrode 44 and the upper electrode 43 is thus improved.

A shape, a length, and a depth of the air communication channel 254 can be easily set. Further, the shape, the length, and the depth of the air communication channel 254 may be appropriately set according to a material of the protection tape, a degree of vacuum at time of attachment of the protection tape and forming the protective film 90, vacuum opening time, and the like. Further, the length and depth of the air communication channel 254 are set so that the film-forming gas does not invade through the communication hole 252 as much as possible.

Next, an operation of the gas detection chamber 255 communicating with the air communication channel 254 is described below.

It is necessary to check whether the film-forming gas has invaded into the terminal opening 252 after formation of the protection film 90. Following methods are applied to check occurrence of invasion of the film-forming gas into the terminal opening 252. For example, component analysis is performed to see whether components of the film-forming gas is attached to the terminal electrode 44. Further, a resistance test may be performed on the terminal electrode 44. Further, discoloration due to adhesion of the film-forming gas on the terminal electrode 44 and the communication channel may be checked.

However, it takes time to analyze the components of the film-forming gas. Further, a resistance test may generate foreign matter. It is difficult to check (discriminate) discoloration of the terminal electrode 44 because an amount of deposited gas adhered to the terminal electrode 44 is very small. Further, it is difficult to check (discriminate) discoloration of the communication channel because light is diffusely reflected depending on a width and a depth of the communication channel.

Therefore, the bonded substrate 200 according to the first embodiment includes the gas detection chambers 255 communicating with the air communication channel 254 (see FIG. 3). The gas detection chamber 255 has a width larger than a width the air communication channel 254 so that a size of the gas detection chamber 255 is large enough to reduce diffused reflection of the light and is easily visible the discoloration of the gas detection chamber 255 by the film-forming gas.

A plurality of the gas detection chambers 255 are connected to the air communication channel 254 in an area of the air communication channel 254 between the communication hole 253 and the terminal opening 252 at predetermined intervals as illustrated in FIGS. 2B and 3.

Thus, the gas detection chambers 255 enable to check at which position of the air communication channel 254 the discoloration caused by the invasion of the film-forming gas occurs in the bonded substrate 200 according to the first embodiment of the present disclosure. Thus, the bonded substrate 200 according to the first embodiment can easily check (discriminate) the invasion of the film-forming gas into the terminal opening 252.

Next, a specific example of invasion of the film-forming gas in the bonded substrate 200 is described with reference to FIG. 5. FIG. 5 is a table illustrating the specific example of the invasion of the film-forming gas in the bonded substrate 200.

Fifty first substrates 201 according to the first embodiment were manufactured. Five second substrates 202 were manufactured in which a channel width W1 and an interval D1 (see FIG. 3) of the air communication channel 254 are varied as illustrated in FIG. 5 in the second substrate 202.

As illustrated in FIG. 2B, a position, at which the air communication channel 254 of the second substrate 202 is arrangeable, is limited to an area of H1=1320 μm in horizontal direction and V1=2000 μm in a vertical direction. Further, meandering of the air communication channel 254 is repeated as much as possible within the area of H1 and V1 in FIG. 2B while keeping the channel width W1 and the interval D1 in FIG. 3.

A depth of the air communication channel 254 mainly depends on the channel width W1. A depth of the common supply channel 58 in the bonded substrate 200 according to the first embodiment is processed to 240 μm. In Examples 1 to 3 of FIG. 5, the depth of the air communication channel 254 was 160 μm, 230 μm in Example 4, and 240 μm in Examples 5 to 8.

The channel width W1 and the interval D1 of the air communication channel 254 in Examples 1 to 8 are as illustrated in FIG. 5, respectively.

The channel width and a length of the air communication channel 254 in the Example 1 are the narrowest and longest among the Examples 1 to 8. Thus, it takes the longest time for the air communication channel 254 to communicate with the outside air, and deformation of the protection tape easily occurs during communication with the outside air. Thus, it is most difficult for the film-forming gas to invade into the terminal opening 252 in a configuration of the air communication channel 254 in the Example 1.

Conversely, the protection tape is most difficult to be deformed in the Example 8, but the film-forming gas easily invades into the terminal opening 252.

It was found in a prior evaluation that the gas detection chamber 255 has to have a size of 100 μm×100 μm (W2×W3 as illustrated in FIG. 33 to detect discoloration when the common supply channel 58 is processed to a depth of 240 μm.

Thus, ten of the gas detection chambers 255 having the size of 100 μm×100 μm were evenly arranged to be fit in a desired area. Further, ten of the gas detection chambers 255 are connected to closest turning parts of the meandering air communication channel 254 at each positions (level) of the gas detection chambers 255 as illustrated in FIG. 3.

In the Example 8, the channel width W1 of the air communication channel 254 (100 μm) is the same as the size of the gas detection chamber 255 (100 μm). The bonded substrate 200 in the Example 8 does not include the gas detection chamber 255 since it is possible to check (detect) an occurrence of invasion of the film-forming gas by the air communication channel 254 itself without the gas detection chamber 255.

To check an effect of the air communication channel 254, ten of the second substrates 202 according to a Comparative Example 1 are manufactured as a comparison target. The bonded substrate 200 in the Comparative Example 1 does not include the air communication channel 254. Thus, a total of fifty second substrates 202 were manufactured.

As illustrated in FIG. 3, the bonded substrate 200 in the first embodiment includes four air communication channels 254 per chip. Further, a shape of a pattern of the air communication channel 254 is a meandering pattern as illustrated in FIG. 3. However, the number and shape of the air communication channel 254 can be appropriately set according to process conditions such as desired attachment conditions of the protection tape and desired film-formation conditions of the protection film 90 as long as two terminal openings 252 of the chip and the communication hole 253 are communicated with each other.

Further, the bonded substrate 200 according to the second embodiment, includes the communication hole 253 connected to the terminal opening 252. The liquid does not flow (pass) through the communication hole 253. However, in some cases, there is not enough area in a layout to provide the communication hole 253 through which the liquid does not flow (pass). If the communication hole 253 cannot be provided in the bonded substrate 200, the terminal opening 252 may be connected to the common supply channel 58 in the first embodiment that serves as the communication hole 253 to obtain the same effect Obtained in the first embodiment as described above if the air communication channel 254 is sealed in a subsequent process.

When the protection tape is attached to the bonded substrate 200, the terminal opening 252 does not become a closed space. Thus, the bonded substrate 200 according to the first embodiment can reduce peeling off of the protection tape from the bonded substrate 200. A pattern of the air communication channel 254 may be formed on a surface of the second substrate 202 to be bonded to the first substrate 201. However, the second substrate 202 has to be carefully bonded to the first substrate 201 so that the pattern of the air communication channel 254 is not filled with adhesive during a bonding process.

Then, the adhesive was thin-film transferred to the surface of the second substrate 202 on which the accommodating portion 251 of a piezoelectric element was formed by flexographic printing. Then, a wafer bonding device is used to apply pressure and hear to bond the first substrate 201 and the second substrate 202 to manufacture fifty bonded substrates 200.

Then, the manufactured bonded substrate 200 is used to check the occurrence of deformation of the protection tape after attachment of the protection tape and the occurrence of the invasion of the film-forming gas after formation of the protection film 90.

The protection tape was attached to the bonded substrate 200 under the conditions of 25° C. and 100 Pa, and the protection film 90 was formed under the conditions of 120° C. and 2 Pa and 8 hours. The results are illustrated in FIG. 5.

Regarding ten bonded substrate of the Comparative Example 1 that does not include the air communication channel 254, all the chips had deformation of the protection tape and invasion of the film-forming gas from a deformed portion of the protection tape. Thus, all the chips of the bonded substrate in the Comparative Example 1 were defective.

Conversely, the protection tape was not deformed at any level (at any positions of the gas detection chambers 255) in the bonded substrate 200 including the air communication channel 254 in the Examples 1 to 8 according to the first embodiment. Regarding the invasion of the film-forming gas, the discoloration of the gas detection chamber 255 was observed in a region closer to the communication hole 253 with increase in the channel width W1. However, none of the bonded substrates 200 in the Examples 1 to 8 has the film-forming gas reaching the terminal opening 252.

Next, the head 1 according to a second embodiment of the present disclosure is described with reference to FIGS. 6 to 11.

Figure 6:
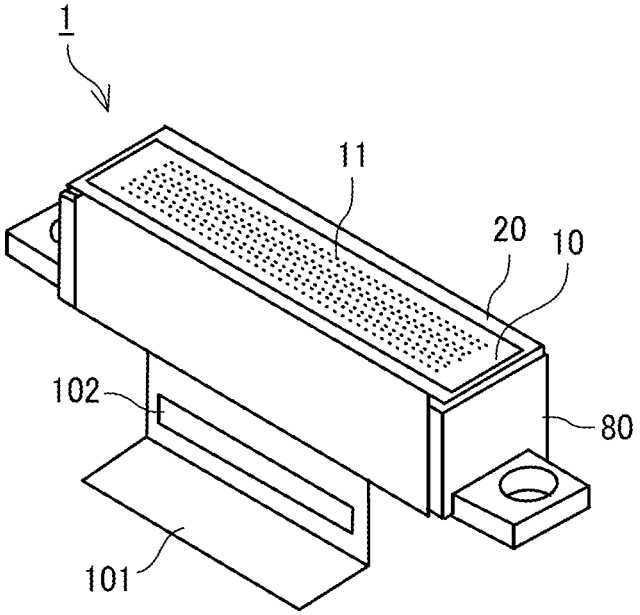
FIG. 6 is an outer perspective view of a liquid discharge head viewed from a nozzle surface side according to a second embodiment of the present disclosure.

FIG. 6 is an outer perspective view of the head 1 viewed from a nozzle surface side according to the second embodiment of the present disclosure.

Figure 7:
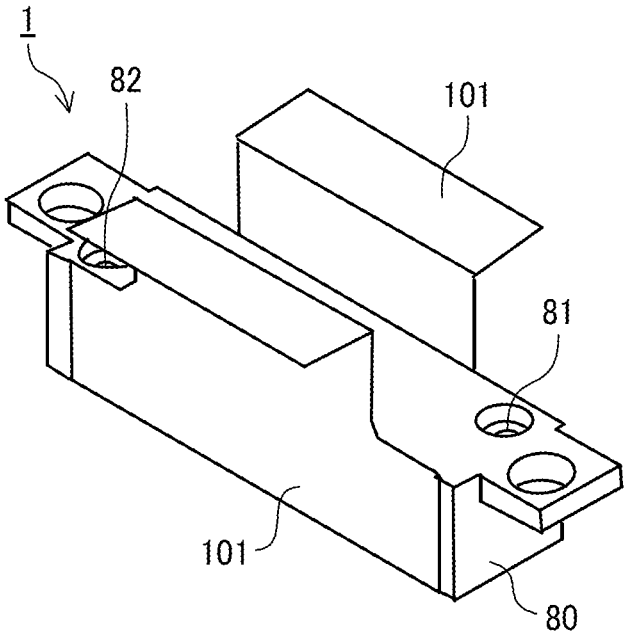
FIG. 7 is an outer perspective view of the liquid discharge head viewed from an opposite side of the nozzle surface side according to the second embodiment of the present disclosure.

FIG. 7 is an outer perspective view of the head 1 viewed from a side opposite to the nozzle surface side according to the second embodiment of the present disclosure.

Figure 8:
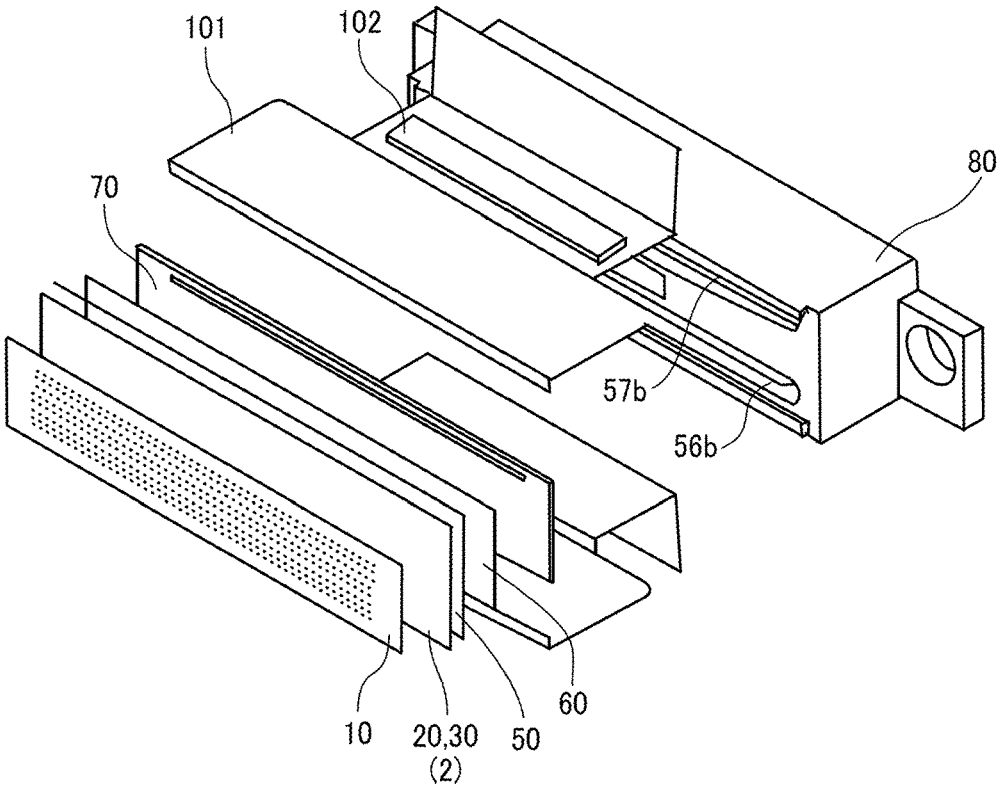
FIG. 8 is an exploded perspective view of the liquid discharge head according to the second embodiment of the present disclosure.

FIG. 8 is an exploded perspective view of the head 1 according to the second embodiment of the present disclosure.

Figure 9:
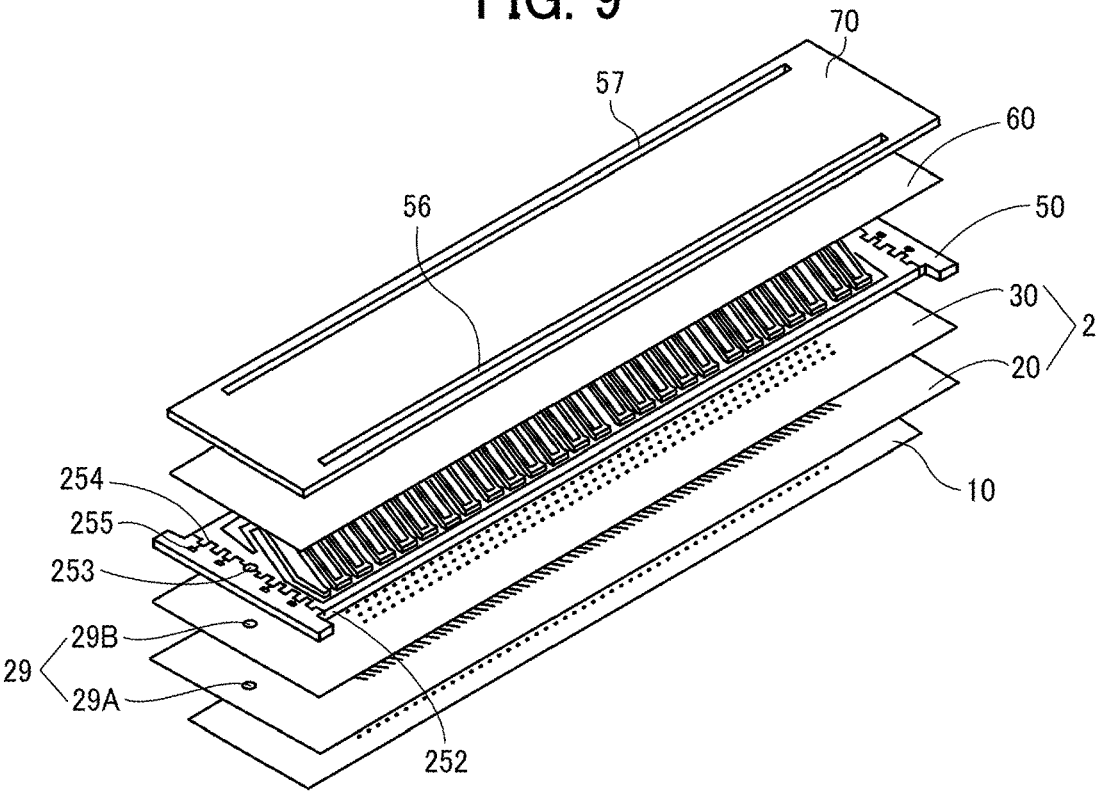
FIG. 9 is an exploded perspective view of a channel forming member of the liquid discharge head according to the second embodiment of the present disclosure.

FIG. 9 is an exploded perspective view of a channel forming member of the head 1 according to the second embodiment of the present disclosure.

Figure 10:
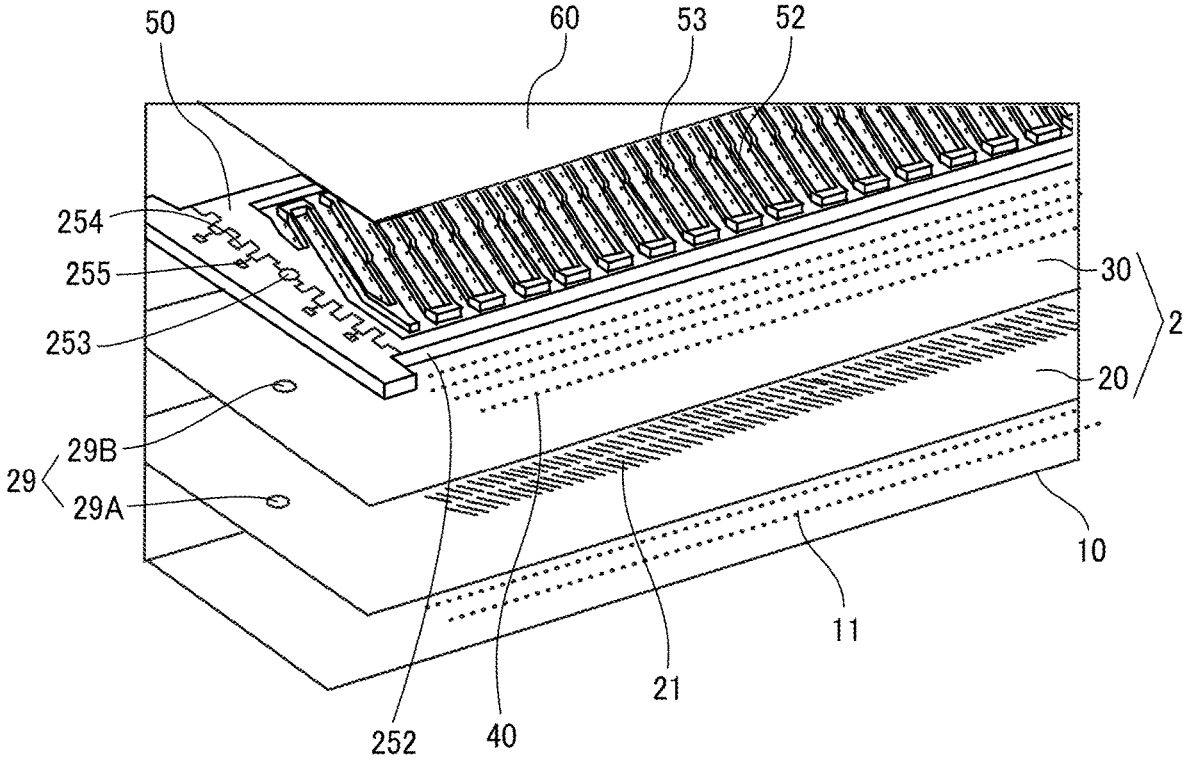
FIG. 10 is an enlarged perspective view of a portion of the channel forming member of FIG. 9.

FIG. 10 is an enlarged perspective view of a portion of the channel forming member of FIG. 9.

Figure 11:
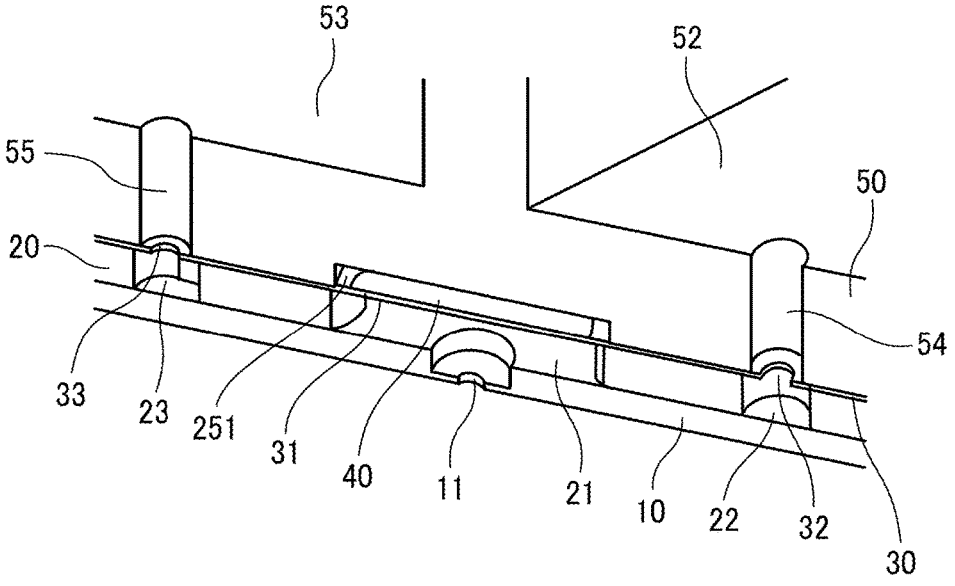
FIG. 11 is a cross-sectional perspective view of channels in the liquid discharge head according to the second embodiment of the present disclosure.

FIG. 11 is a cross-sectional perspective view of channels of the head 1.

The head 1 includes a nozzle plate 10, an individual-channel member 20 (channel plate), a diaphragm member 30, a common-branch channel member 50, a damper 60, a common-main channel member 70, a frame 80, and a flexible wiring 101 (wiring board) as the second substrate 202. The head 1 includes a head driver 102 (driver IC) mounted on the flexible wiring 101 (wiring board). The head 1 in the second embodiment includes the actuator substrate 2 serving as the first substrate 201 formed by the individual-channel member 20 (channel plate) and the diaphragm member 30.

The nozzle plate 10 includes a plurality of nozzles 11 to discharge a liquid (see FIG. 6). The plurality of nozzles 11 are arrayed in a two-dimensional matrix.

The individual-Channel member 20 includes a plurality of pressure chambers 21 (individual chambers) respectively communicating with the plurality of nozzles 11, a plurality of individual-supply channels 22 respectively communicating with the plurality of pressure chambers 21, and a plurality of individual-collection channels 23 respectively communicating with the plurality of pressure chambers 21 (see FIG. 11).

A combination of one pressure chamber 21, one individual-supply channel 22 communicating with one pressure chamber 21, and one individual-collection channel 23 communicating with one pressure chamber 21 is collectively referred to as an individual chamber 25.

The diaphragm member 30 forms a diaphragm 31 serving as a deformable wall of the pressure chamber 21, and the piezoelectric element 40 is formed on the diaphragm 31 so that the piezoelectric element 40 and the diaphragm 31 form a single body. Further, the diaphragm member 30 includes the supply opening 32 that communicates with the individual-supply channel 22 and a collection opening 33 that communicates with the individual-collection channel 23 (see FIG. 11). The piezoelectric element 40 is a pressure generator to deform the diaphragm 31 to pressurize the liquid in the pressure chamber 21.

Note that the individual-channel member 20 and the diaphragm member 30 are not limited to be separate members. For example, an identical member such as a Silicon on Insulator (SOI) substrate may be used to form the individual-channel member 20 and the diaphragm member 30 in a single unit. That is, an SOI substrate formed by sequentially film-forming a silicon oxide film, a silicon layer, and a silicon oxide film on a silicon substrate is used. The silicon substrate in the 501 substrate forms the individual-channel member 20, and the silicon oxide film, the silicon layer, and the silicon oxide film in the SOI substrate form the diaphragm 31. In such a configuration, the layer structure of the silicon oxide film, the silicon layer, and the silicon oxide film of the SOI substrate constitutes the diaphragm member 30. As described above, the diaphragm member 30 includes a member made of the material that is film-formed on a surface of the individual-channel member 20.

The head 1 includes a through hole 29A in the individual-channel member 20 and a through hole 29B in the diaphragm member 30. The through holes 29A and 29B form a through bole 29 penetrating the actuator substrate 2 which forms the first substrate 201 as described above.

The common-branch channel member 50 includes a plurality of common-supply branch channels 52 that communicate with two or more individual-supply channels 22 and a plurality of common-collection branch channels 53 that communicate with two or more individual-collection channels 23. The plurality of common-supply branch channels 52 and the plurality of common-collection branch channels 53 are arranged alternately adjacent to each other (see FIG. 10).

As illustrated in FIG. 11, the common branch channel member 50 includes a through hole serving as a supply port 54 that connects the supply opening 32 of the individual-supply channel 22 and the common-supply branch channel 52, and a through hole serving as a collection port 55 that connects the collection opening 33 of the individual-collection channel 23 and the common-collection branch channel 53.

The common-branch channel member 50 includes a part 56*b* of one or more common-supply main channels 56 that communicate with the plurality of common-supply branch channels 52, and a part 57*b* of one or more common-collection main channels 57 that communicate with the plurality of common-collection branch channels 53 (see FIGS. 8 to 10).

The common-branch channel member 50 is the second substrate 202 as described above to be bonded to the actuator substrate 2 serving as the first substrate 201. The common-branch channel member 50 (second substrate 202) includes the accommodating portion 251 to accommodate the piezoelectric element 40 of the actuator substrate 2 (first substrate 201) and the terminal opening 252 that exposes a terminal electrode 44 as described in the first embodiment connected to the piezoelectric element 40 of the actuator substrate 2 (first substrate 201).

Further, the common-branch channel member 50 (second substrate 202) includes the communication hole 253 communicating with the through hole 29 of the actuator substrate 2. The common-branch channel member 50 (second substrate 202) further includes the air communication channel 254 on a surface opposite to a bonding surface of the actuator substrate 2 (first substrate 201). The air communication channel 254 communicates the terminal opening 252 and the communication hole 253.

Here, as illustrated in FIG. 3, the air communication channel 254 has a pattern formed in a square waved shape meandering between the communication hole 253 and the terminal opening 252. A plurality of gas detection chambers 255 communicates with the air communication channel 254 at predetermined intervals.

As illustrated in FIG. 10, the damper 60 includes a supply-side damper that faces (opposes) the supply port 54 of the common-supply branch channel 52 and a collection-side damper that faces (opposes) the collection port 55 of the common-collection branch channel 53.

As illustrated in FIG. 10, the damper 60 seals grooves alternately arrayed in the same common-branch channel member 50 to form the common-supply branch channel 52 and the common-collection branch channel 53. The damper 60 forms a deformable wall.

The common-main channel member 70 forms a common-supply main channel 56 that communicates with the plurality of common-supply branch channels 52 and a common-collection main channel 57 that communicate with the plurality of common-collection branch channels 53 see FIGS. 9 and 10).

The frame 80 includes a part 56*b* of the common-supply main channel 56 and a part 57*b* of the common-collection main channel 57 (see FIG. 8). The part 56*b* of the common-supply main channel 56 communicates with a supply port 81 in the frame 80. The part 57*b* of the common-collection main channel 57 communicates with a collection port 82 in the frame 80.

The bonded substrate 200 thus configured can prevent film-formation of the protection film 90 on the terminal electrode 44 electrically connected to the piezoelectric element 40 (pressure generator) as similar to the first embodiment as described above. Thus, the bonded substrate 200 improves reliability of the electrical connections between the terminal electrode 44 and the upper electrode 43.

Figure 12:
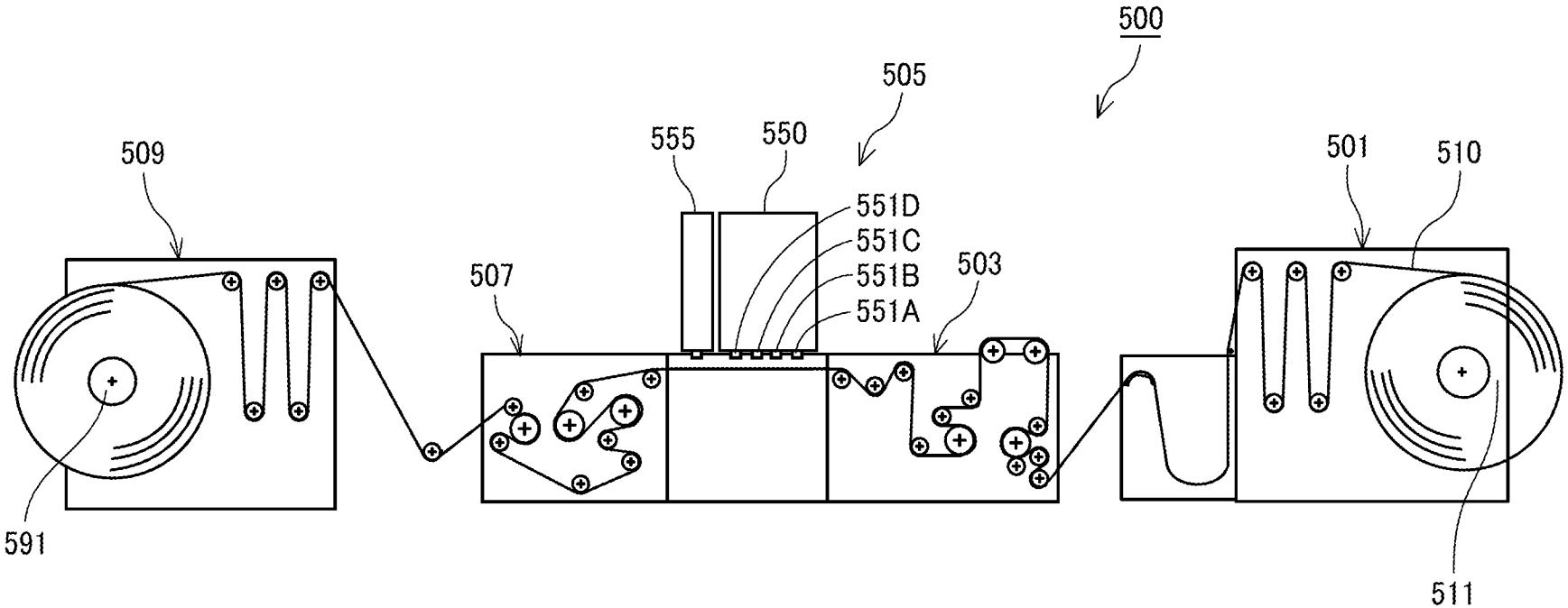
FIG. 12 is a schematic cross-sectional from view of a liquid discharge apparatus according to a third embodiment of the present disclosure.
Figure 13:
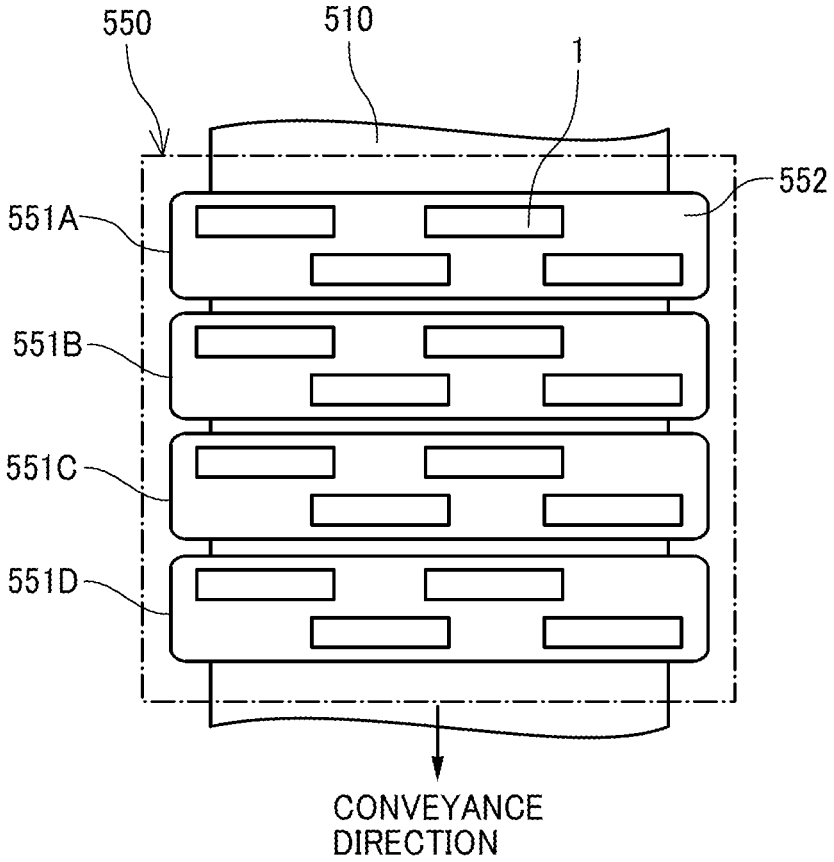
FIG. 13 is a plan view of an example of a discharge device of the liquid discharge apparatus of FIG. 12.

An example of a liquid discharge apparatus according to a third embodiment of the present disclosure is described with reference to FIGS. 12 and 13. FIG. 12 is a schematic cross-sectional front view of the liquid discharge apparatus. FIG. 13 is a plan view of a discharge device 550 of the liquid discharge apparatus of FIG. 12 according to the third embodiment of the present disclosure.

A printer 500 serving as the liquid discharge apparatus includes a feeder 501, a guide conveyor 503, a printing device 505, a dryer 507, and an ejector 509. The feeder 501 feeds a continuous medium 510 such as a roiled sheet. The guide conveyor 503 guides and conveys the continuous medium 510, fed from the feeder 501, to the printing device 505. The printing device 505 discharges a liquid onto the continuous medium 510 to form an image on the continuous medium 510. The dryer 507 dries the continuous medium 510. The ejector 509 ejects the continuous medium 510.

The continuous medium 510 is fed from a winding roller 511 of the feeder 501, guided and conveyed with rollers of the feeder 501, the guide conveyor 503, the dryer 507, and wound around a take-up roller 591 of the ejector 509.

The continuous medium 510 is conveyed opposite a discharge device 550 and a discharge device 555 on a conveyance guide. In the printing device 505, the continuous medium 510 is conveyed to face the discharge device 555. The discharge device 550 discharges the liquid onto the continuous medium 510 to form an image on the continuous medium 510. The discharge device 555 discharges a treatment liquid onto the continuous medium 510 to perform post-treatment on the continuous medium 510 with the treatment liquid.

The discharge device 550 includes, for example, four-color full-line head arrays 551A, 551B, 551C, and 551D from an upstream side in the direction of conveyance of the continuous medium 510 indicated by arrow "conveyance direction" in FIG. 13. The head arrays 551A, 551B, 551C, and 551D are collectively referred to as "head arrays 551" unless colors are distinguished.

Each of the head arrays 551 is a liquid discharge device to discharge liquid of black (K), cyan (C), magenta (M), and yellow (Y) onto the continuous medium 510 conveyed along the conveyance direction of the continuous medium 510. Note that number and types of color are not limited to the above-described four colors of K, C, M, and Y and may be any other suitable number and types.

In each head arrays 551, for example, as illustrated in FIG. 13, heads 1 are staggered on a base 552 to form the head array 551. Note that the configuration of the head array 551 is not limited to such a configuration. The head 1 has a configuration of one of the head 1 illustrated in FIGS. 1 to 11.

In the above-described embodiments, the bonded substrate 200 is a member to form the head 1. However, the bonded substrate 200 is not limited to form the head 1. The bonded substrate 200 includes the first substrate 201 including the terminal electrode 44 and the second substrate 202 including the terminal opening 252 to expose the terminal electrode 44 of the first substrate 201. The first substrate 201 and the second substrate 202 are bonded in the bonded substrate 200. The first substrate 201 includes a through hole 29 that penetrates through the first substrate 201. The second substrate 202 includes the communication hole 253 that communicates with the through hole 29 of the first substrate 201. The second substrate 202 includes the air communication channel 254 on a surface opposite to the bonding surface of the first substrate 201. The air communication channel 254 communicates the terminal opening 252 and the communication hole 253.

Examples of such bonded substrates 200 include semiconductor substrates.

Thus, the bonded substrate 200 improves reliability of the electrical connections between the terminal electrode 44 and the upper electrode 43.

In the present embodiments, a "liquid" discharged from the head is not particularly limited as long as the liquid has a viscosity and surface tension of degrees dischargeable from the head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or mechanism combined to the head to form a single unit. For example, the "liquid discharge device" includes a combination of the head with at least one of a head tank, a carriage, a supply unit, a maintenance unit, a main scan moving unit, and a liquid circulation apparatus.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another. The head may be detachably attached to the functional part(s) or unit(s) each other.

For example, the head and the head tank may form the liquid discharge device as a single unit. Alternatively, the head and the head tank coupled (connected) with a tube or the like may form the liquid discharge device as a single unit. Here, a unit including a filter may further be added to a portion between the head tank and the head of the liquid discharge device.

Examples of the liquid discharge device further include the tread coupled (connected) with a carriage to form a single unit.

The liquid discharge device may include the head movably held by a guide that forms part of a main scan moving unit, so that the head and the main scan moving unit form a single unit. The liquid discharge device may include the head, the carriage, and the main scan moving unit that form a single unit.

Examples of the liquid discharge device further include the head, the carriage, and the maintenance mechanism to form a single unit, in such a manner that the head is mounted on the carriage and a cap of the maintenance mechanism is secured to the carriage.

Further, the liquid discharge device may include a tube connected to the head mounting the head tank or the channel member so that the head and a supply unit form a single unit. Liquid is supplied from a liquid reservoir source to the bead via the tube.

The main scan moving unit may be a guide only. The supply unit may be a tube(s) only or a loading unit only.

Here, the "liquid discharge device" may be a single unit in which the head and other functional parts are combined with each other. However, the "discharge device" may include a head module or a head device including the above-described head, and the discharge device in which the above-described functional components and mechanisms are combined to form a single unit.

The term "liquid discharge apparatus" used herein also represents an apparatus including the head, the discharge device, the bead module, and the head device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material onto which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material on which liquid is at least temporarily adhered, a material on which liquid is adhered and fixed, or a material into which liquid is adhered to permeate.

Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell. The "material onto which liquid can adhere" includes any material on which liquid is adhered, unless particularly limited.

Examples of the "material onto which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material onto which liquid can adhere. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image priming", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a nozzle configured to discharge a liquid;

a pressure chamber communicating with the nozzle;

a pressure generator configured to apply pressure on the pressure chamber;

a first substrate including a terminal electrode connected to the pressure generator; and a second substrate including a bonding surface bonded to the first substrate, the second substrate including a terminal opening exposing the terminal electrode of the first substrate, wherein the first substrate includes a through hole penetrating through the first substrate, and the second substrate includes:

a communication hole communicating with the through hole of the first substrate; and an air communication channel on a surface opposite to the bonding surface, the air communication channel communicating with the terminal opening and the communicating hole.

2. The liquid discharge bead according to claim 1, further comprising:

a channel configured to supply the liquid to the pressure chamber, wherein the through hole of the first substrate is separated from the channel.

3. The liquid discharge head according to claim 1, wherein the second substrate further includes:

a gas detection chamber connected to the air communication channel, and the gas detection chamber has a width larger than the air communication channel.

4. The liquid discharge head according to claim 3, wherein the was detection chamber includes a plurality of gas detection chambers, and the plurality of gas detection chambers are connected to the air communication channel at predetermined interval on the second substrate.

5. The liquid discharge head according to claim 1, wherein the air communication channel has a square waved shape meandering between the communication hole and the terminal opening.

6. The liquid discharge head according to claim 1, wherein the air communication channel and the communication hole are formed on each end of the second substrate in a longitudinal direction of the second substrate.

7. A discharge device comprising the liquid discharge head according to claim 1.

8. A liquid discharge apparatus comprising the discharge device according to claim 7.

9. The liquid discharge head according to claim 1, further comprising:

a channel configured to supply the liquid to the pressure chamber, wherein the communication hole of the second substrate is separated from the channel.

10. A bonded substrate comprising:

a first substrate including a terminal electrode; and a second substrate including a bonding surface bonded to the first substrate, the second substrate including a terminal opening exposing the terminal electrode of the first substrate, wherein the first substrate includes a through hole penetrating through the first substrate, and the second substrate includes:

a communication hole communicating with the through hole of the first substrate; and an air communication channel on a surface opposite to the bonding surface, the air communication channel communicating with the terminal opening and the communicating hole.

* * * * *